United States Patent [19]

Stanton

[11] 4,019,759

[45] Apr. 26, 1977

[54] INDEXING SYSTEM

[76] Inventor: Bernard M. Stanton, 4605 Ocean Front Ave., Virginia Beach, Va. 23451

[22] Filed: Jan. 20, 1976

[21] Appl. No.: 650,709

[52] U.S. Cl. ..... 283/42; 40/360

[51] Int. Cl.[2] ..... B42F 22/00

[58] Field of Search ..... 283/37, 42; 40/23 A, 40/359, 360

[56] References Cited

UNITED STATES PATENTS

| | | | |
|---|---|---|---|
| 2,314,578 | 3/1943 | Erb | 283/42 |
| 3,191,767 | 6/1965 | Glowiak | 40/23 A X |

*Primary Examiner*—Lawrence Charles
*Attorney, Agent, or Firm*—Dennison, Dennison, Meserole & Pollack

[57] ABSTRACT

For use in a multi-page book, an index system comprising elongated flat transparent plastic index tabs each affixed by a strip of transparent adhesive tape. The tab overlies one edge of an associated page, projecting slightly outward therefrom so as to present an indicia bearing end and projecting a substantially greater distance inwardly thereof, terminating in an inner end. The transparent adhesive tape overlies the inner end, overlapping both the adjacent inner portion of the tab and the page face, providing a point of attachment substantially inward of the page edge. Removal of the tab for reuse is effected by a rotation of the tab about the adhesively secured inner edge, partially peeling the tape back so as to enable a complete exposure of the tab and a twisting removal thereof from the tape, the tape subsequently being reapplied to the page.

9 Claims, 6 Drawing Figures

INDEXING SYSTEM

The invention herein generally relates to an indexing system for a multiple page book, usually of the type having a limited life and using thin relatively poor quality paper such as telephone directories, monthly airline guides, and the like.

More specifically, the indexing system involves the utilization of an elongated flat relatively rigid transparent index tab and means for mounting the tab which protects the page receiving the tab and allows for a removal of the tab for reuse while at the same time maintaining the integrity of the page from which the tab is removed.

The prior art relating to indexing devices is both old and extensive as indicated by the following patents known to applicant:

176,005 — Jones
201,693 — McKnight
1,069,092 — Wise
1,285,579 — Anthony
1,625,154 — Rand
2,348,909 — Jonas
2,314,578 — Erb
3,463,515 — Thompson The patents to Erb and Thompson appear to constitute the most advanced developments in those areas with which the present invention is concerned. For example, Erb, in FIG. 5, secures his tab in position by a specially formed section of "Scotch tape" overlying the inner portion of the tab outward of the inner end thereof and including a transverse zone devoid of adhesive so as to allow for a cutting and peeling back of the tape for a removal of the tab and a subsequent replacement of the tape. The Thompson patent provides a transparent tab coated with a transparent adhesive which terminates short of the page edge so as to leave an area without adhesive, thereby avoiding a shearing force directly at the page edge upon use of the tab. The Thompson tab is not removable and reusable and, in the commercial embodiment thereof, provides an adhesive free zone inward of the page edge of only approximately one-eighth inch.

It is the primary intention of the present invention to provide an indexing system, including a reusable index tab and mounting means therefore, which substantially improves on what has heretofore been developed, particularly as exemplified by the Erb and Thompson patents.

More particularly, one of the significant objects of the present invention resides in the provision of a system whereby the individual index tabs can be mounted using a conventional strip of transparent adhesive tape with the removal of the tab for reuse, while providing for a retention of the integrity of the page, being easily effected by only a manual manipulation and without the necessity of using scissors or the like. This arrangement greatly improves over the Erb system wherein the tape must be specifically formed with a central adhesive free zone which in turn must be properly located over the tab and must, in some manner, be cut to allow for a removal of the tab.

Further, it is significant that the invention herein provides for a substantially greater protection of the tab mounting page from any tendency for the tab receiving edge to tear by the positioning of the area of attachment a substantial distance inward of the edge, on the order of one inch as opposed to the one-eighth inch of Thompson, while at the same time providing for an area of attachment which is substantially wider than the tab itself.

Other objects of the invention include the provision of an indexing system which is easy to use, inexpensive, non-destructive to the pages, and capable of economical manufacture using conventional material.

Basically, the objects of the invention are achieved by the provision of an index tab of rigid or slightly flexible transparent material in conjunction with a strip of conventional transparent adhesive tape. The tab is approximately one and one-half inches long and orientated so as to overly the edge of an associated page, projecting approximately one-quarter to five-sixteenth inch therebeyond. The inner end portion of the tab is provided with a transverse line approximately one-quarter inch from the inner end, providing a guage for the application of the adhesive tape, normally one-half inch wide, transversely across the inner end and inner end portion of the tab in a manner so as to completely overlie the inner end and extend both inward thereof and to the sides thereof. In this manner, the mounting of the tab is effected approximately one inch from the page edge so as to effectively preclude any tearing thereof during use of the tab. When removal of the tab for reuse is desired, the tab is merely folder upward and inward about the secured inner end thereof, peeling back a portion of the adhesive tape until the complete face of the tab is exposed. At that point, the tab is twisted so as to lift it easily from the tape, after which the tape is reapplied to the page so as to reposition any printing which might have unavoidably been raised with the initial peeling of the tape. In this manner, the tab is free for reuse and the page is restored to its original condition other than for the small strip of transparent tape thereon.

Other objects and advantages will become apparent from the following detailed description of the construction and operation of the invention. Reference is had to the accompanying drawings forming a part hereof wherein like numerals refer to like parts throughout, and in which.

Figure 1:
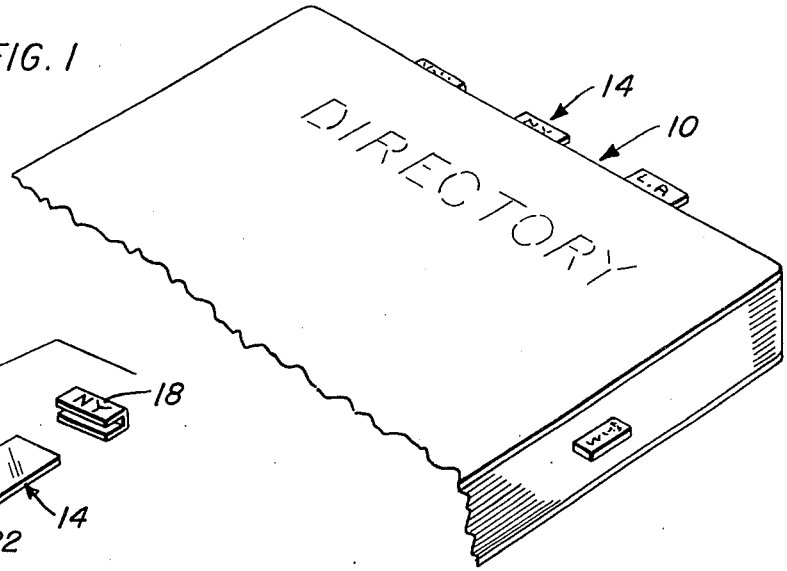
FIG. 1 is a partial perspective view of a multi-page book having the index tabs of the invention applied thereto.
Figure 2:
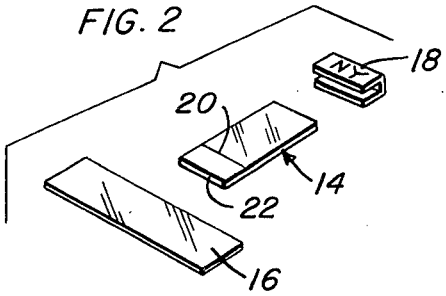
FIG. 2 is an exploded perspective view of the basic components of the index system.
Figure 3:
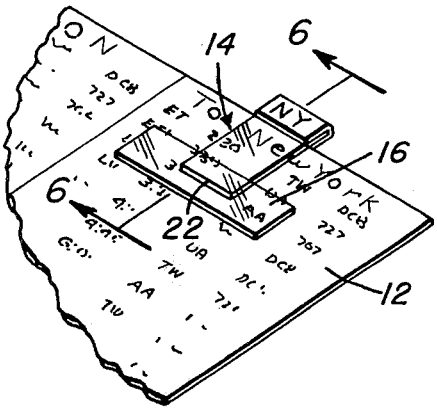
FIG. 3 is a perspective detail of a mounted index tab.

Referring now more specifically to the drawings, FIG. 1 illustrates a multi-page book of the type with which the indexing system of the invention will normally be used.

Basically, each page 12 to be indexed is provided with an index tab 14 removably affixed thereto by a strip of transparent adhesive mounting tape 16.

Each index tab 14 is transparent and of a rigid or semi-rigid plastic sheet material preferably ¾ inch wide and 1 and ½ inches long. The outer one-quarter to 5/16 inch of the tab is provided with identifying indicia 18 which is visible on the opposed faces thereof. This indicia 18 can be off-set or silk screen printed directly on the tab, written on a blank white panel provided on the tab, or provided by a separate folded strip of gummed paper, as illustrated, preprinted or blank for receiving written indicia. The tab is completed by the provision of a positioning line 20 transversely across the inner end portion of the tab 14 approximately ¼ inch from the extreme inner end 22. This line 20 acts as a guide for a positioning of the transparent adhesive mounting tape 16 which is in itself conventional tape. The tape used will normally be ½ inch wide and approximately 1 and ¼ inch long.

In mounting a tab 14, the tab 14 will be positioned so as to overlie the associated page 12 and project perpendicularly across one edge thereof, projecting outward approximately ¼ to 5/16 inch with the inner edge of the indicia 18 aligned with the page edge and projecting inwardly with the inner end 22 approximately 1 and ¼ inches from the page edge. When so positioned, a strip of conventional transparent adhesive tape 16 is applied transversely across the inner end portion of the tab 14 with one edge of the tape 16 aligning with the guide line 20 whereby one half of the width of the ½ inch tape 16 will overlie the inner portion and inner end of the tab 14 with the remaining width of the tape 16 being directly affixed to the page inward of the tab. The tape 16, normally being one and one-quarter inches, will also project approximately one-quarter inch beyond the opposed sides of the tab 14 for direct engagement with the page surface. In this manner, the tab 14 will be effectively locked to the page 12 with any force transmitted from the tab to the page during the use thereof being effectively spread over a substantial area transversely elongated relative to the inner end of the tab and located a substantial distance inward of the edge of the page over which the tab lies. As will be appreciated, the tab 14 should also be positioned laterally inward of any page edge perpendicular to that over which the tab projects so as to allow for a full bearing surface for the mounting tape 16. Mounted in this manner, it will be recognized that the lifting force applied to the outer indicia carrying end of the index tab 14 is transferred to a wide bearing area located a substantial distance, on the order of one inch, inward of the edge of the page 12 whereby any tendency for the edge of the page to tear is eliminated. Likewise, the rigid or semi-rigid nature of the tab 14 allows for a full transfer of the lifting force thereon to the pages forward thereof without the transfer of undo stress to the adhesive tape 16 used to mount the tab. Incidentally, while the tab has been illustrated as mounted on the front or forward face of the associated page, it will be appreciated that the tab is equally adapted for mounting on the lower or rear face of the page.

A particularly significant feature of the indexing system is the fact that the tab is removable and reusable without any affect on the integrity of the page or visibility of the indicia thereon. In this regard, and as will be appreciated from the drawings, the length and manner of mounting of the tab is such so as to normally position the tab and mounting tape over a portion of the page indicia or writing. However, the transparent nature of the tab and tape allows for a full viewing of the page material.

Figure 4:
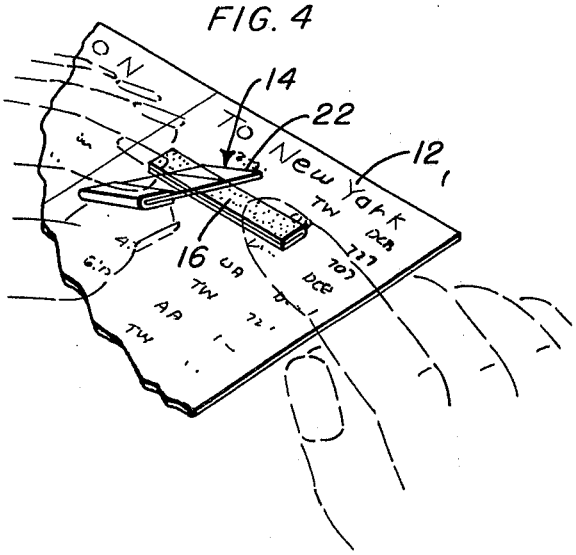
FIG. 4 illustrates the initial steps in removing the tab for reuse.
Figure 5:
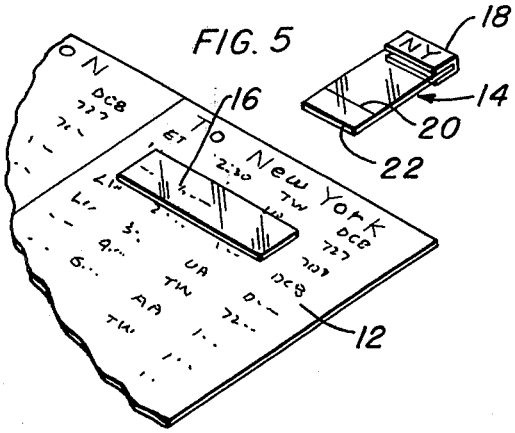
FIG. 5 illustrates a restored page with the tab removed.
Figure 6:
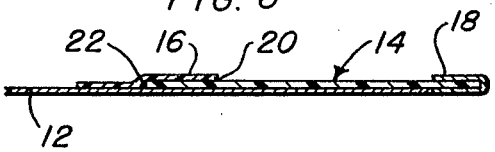
FIG. 6 is an enlarged cross-sectional detail taken substantially on a plan passing along line 6–6 in FIG. 3.

Noting FIGS. 4 and 5 in particular, the removal of the individual tabs involves an initial folding or pivoting of the tab 14 upward and inward about the secured lower end 22 thereof so as to completely expose one face of the tab 14. This will normally require a 180 degree turn of the tab 14 and an accompanying peeling back of approximately one half of the width of the tape 16. This peeling back of the tape 16 might effect a raising of some of the printed matter. Upon an exposure of the entire tab 14, one edge of the peeled portion of the tape 16 is stabilized with a finger and the tab 14 easily twisted to one side so as to strip the tab from the tape. After a removal of the tab 14 in this manner, the raised portion of the tape 16 is folded back over the page and resecured using the original adhesive thereon, sufficient adhesive remaining in at least that portion from which the tab was removed so as to effect a positive reattachment of the tape 16. In this manner, any printed matter originally raised by a peeling back of the portion of the width of the tape 16 is repositioned, thus presenting a complete page with all of the matter thereon intact. The tab 14 can then be reused as desired, requiring only another strip of conventional transparent adhesive tape.

From the foregoing, it will be appreciated that a significant advance has been achieved in the relatively crowded field of tab indexing systems. The indexing arrangement proposed herein provides an effective means for indexing selected pages of a multi-page book in a manner which fully protects the integrity of the individual pages both during use of the tab and after removal of the tab for reuse. In addition, the system herein requires only the use of rigid or relatively rigid tabs in conjunction with conventional transparent adhesive tape, so mounted and applied as to allow for continued reuse of the tabs without destruction of the pages from which the tabs are removed.

The foregoing is considered illustrative of the principals of the invention. Since modifications and/or variations may occur to those skilled in the art, it is not desired to limit the invention to the exact construction and manner of use shown and described. Accordingly, all suitable modifications and equivalents may be resorted to, falling within the scope of the invention as claimed.

What is claimed is:

1. In a multiple page book, an index system comprising index tabs associated with selected pages of the book, and mounting means removably securing each tab on the associated page, each of said index tabs comprising a flat strip of transparent material, each tab overlying one edge of the associated page and projecting both outwardly and inwardly of said one edge, said tab terminating in an inner end inwardly spaced from said one edge, said mounting means comprising transparent adhesive tape overlying and affixed to said inner end and the portion of the tab immediately adjacent thereto, said tape projecting inwardly beyond said inner end and being secured to the associated page, thereby fixing said tab to the page in a manner whereby the tab can pivot upwardly away from said page about the inner end for a complete exposure of said tab, without stripping of that portion of the tape inward of the inner edge, to enable a stripping of the tab from the page secured tape and a repositioning of the tape on the page.

2. The index system of claim 1 wherein said tape extends parallel to and along the full length of the inner end of the tab.

3. The index system of claim 2 wherein said tape extends beyond the opposed sides of the tab adjacent to the inner end thereof.

4. The index system of claim 3 wherein said tape overlaps approximately equal portions of the tab and the page along the length of the inner end of the tab.

5. The index system of claim 4 wherein said tab is of a length whereby the inner end and overlapping tape are positioned a distance inwardly spaced from the page edge substantially greater than the width of the tape.

6. The index system of claim 5 wherein the portion of the tab outward of the page edge is provided with identifying indicia on the opposed faces thereof.

7. The index system of claim 2 wherein said tape overlaps approximately equal portions of the tab and the page along the length of the inner end of the tab.

8. The index system of claim 7 wherein said tab is of a length whereby the inner end and overlapping tape are positioned a distance inwardly spaced from the page edge substantially greater than the width of the tape.

9. A method of mounting and removing an index tab on and from a page comprising;

in the mounting of the tab, the steps of positioning the tab flat on a page so as to overlie an edge of the page and project both inwardly and outwardly thereof, and applying transparent adhesive tape over the inner end of the tab, the portion of the tab immediately adjoining the inner end, and the portion of the page immediately adjacent and inward of the inner end of the tab; and in the removing of the tab, the steps of inverting the tab and the portion of the tape secured thereto about the inner end of the tab so as to completely expose one face of the tab and a portion of the tape while retaining the portion of the tape over that portion of the page inward of the inner end of the tab, stripping the tab away from the tape, and affixing to the page the portion of the tape exposed by the inverting and removal of the tab.

* * * * *